US009062918B2

(12) United States Patent
He et al.

(10) Patent No.: US 9,062,918 B2
(45) Date of Patent: Jun. 23, 2015

(54) STEAM GENERATOR

(75) Inventors: Shuyan He, Beijing (CN); Huaiming Ju, Beijing (CN); Xinxin Wu, Beijing (CN); Xiaowei Luo, Beijing (CN); Zhengming Zhang, Beijing (CN); Zongxin Wu, Beijing (CN); Zuoyi Zhang, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 504 days.

(21) Appl. No.: 13/318,729

(22) PCT Filed: Jun. 18, 2009

(86) PCT No.: PCT/CN2009/000666

§ 371 (c)(1),
(2), (4) Date: Nov. 3, 2011

(87) PCT Pub. No.: WO2010/127471

PCT Pub. Date: Nov. 11, 2010

(65) Prior Publication Data

US 2012/0048527 A1 Mar. 1, 2012

(30) Foreign Application Priority Data

May 6, 2009 (CN) ..... 2009 1 0083490

(51) Int. Cl.

| | |
|---|---|
| ***F28D 7/02*** | (2006.01) |
| ***F28F 9/02*** | (2006.01) |
| ***F22B 1/18*** | (2006.01) |
| ***F22B 29/06*** | (2006.01) |

(52) U.S. Cl.

CPC ..... *F28D 7/024* (2013.01); *F28F 9/028* (2013.01); *F22B 1/18* (2013.01); *F22B 29/06* (2013.01)

(58) Field of Classification Search

USPC ..... 165/11.1, 76, 160, 163; 122/406.3

See application file for complete search history.

(56) References Cited

U.S. PATENT DOCUMENTS

| | | | | |
|---|---|---|---|---|
| 1,819,785 | A * | 8/1931 | Muhleisen | 165/145 |
| 1,874,527 | A * | 8/1932 | Herpen | 122/39 |
| 1,973,100 | A * | 9/1934 | Rawson | 165/69 |
| 2,035,908 | A * | 3/1936 | Michel | 122/250 R |
| 2,143,287 | A * | 1/1939 | Smith | 165/163 |
| 2,602,644 | A * | 7/1952 | Sandstrom | 165/84 |

(Continued)

FOREIGN PATENT DOCUMENTS

| | | |
|---|---|---|
| CN | 1266267 A | 9/2000 |
| GB | 969319 | 9/1964 |
| GB | 947662 | 11/1964 |

*Primary Examiner* — Allen Flanigan

(74) *Attorney, Agent, or Firm* — Greer, Burns & Crain, Ltd.

(57) ABSTRACT

A steam generator includes a heat exchanger, a liquid header and a steam header. The heat exchanger is assembled by several heat exchanging subassemblies with the same structure. The heat exchanging subassembly includes a spiral heat transmission pipe bundle, a central cylinder and a sleeve. The spiral heat transmission pipes with different radii are concentrically and spirally arranged in an annular space between the central cylinder and the sleeve, to form one or more concentric heat exchanging pillar surfaces. One end of the liquid header is connected with a main water feeding pipe, and the other end of the liquid header is connected with the spiral heat transmission pipe bundle. One end of the steam header is connected with a main steam pipe, and the other end of the steam header is connected with the spiral heat transmission pipe bundle.

4 Claims, 4 Drawing Sheets

(56) References Cited

U.S. PATENT DOCUMENTS

| | | | | | |
|---|---|---|---|---|---|
| 2,693,346 | A | * | 11/1954 | Petersen | 165/160 |
| 2,990,162 | A | * | 6/1961 | Otten | 165/140 |
| 3,053,512 | A | * | 9/1962 | Mercier et al. | 165/82 |
| 3,116,790 | A | * | 1/1964 | Walter | 165/163 |
| 3,130,779 | A | * | 4/1964 | Huet | 165/146 |
| 3,563,303 | A | * | 2/1971 | Gilli et al. | 165/11.1 |
| 3,871,444 | A | * | 3/1975 | Houser et al. | 165/101 |
| 3,983,903 | A | * | 10/1976 | Kuehn, Jr. | 138/40 |
| 4,014,295 | A | * | 3/1977 | Lions | 122/32 |
| 4,488,513 | A | | 12/1984 | Jahnke et al. | |
| 6,189,491 | B1 | | 2/2001 | Wittchow et al. | |
| 2010/0096115 | A1 | * | 4/2010 | Erickson | 165/156 |

* cited by examiner

STEAM GENERATOR

TECHNICAL FIELD

The present invention relates to the technical field of steam power cycle, and particularly relates to a steam generator.

BACKGROUND ART

On the basis of Rankine cycle, the water vapor power cycle has been widely used in the fields of nuclear power, combined fuel gas-steam cycle and coal-fired power station, etc. In these fields, the generation of water vapor with high temperature and high heat is the first step for the conversion from the thermal energy into the power. At present, there are mainly two types of equipments for the generation of water vapor, which are the natural cycle steam generator and the once-through steam generator. In comparison with the natural cycle steam generator, the once-through steam generator can directly generate overheated steam and steam with super high pressure and supercritical parameters, which has not only higher generating efficiency, but also a compact structure.

According to its way of arrangement in the once-through type steam generator, a hot water pipe can be classified into two types which are the straight pipe and the spiral pipe. In comparison with the arrangement of the spiral pipe, the structure of the once-through steam generator of a straight pipe type is simpler, but as the material of its heat exchanging pipe is different from that of its cylinder, there is a difference between their linear expansions, resulting in the concentration of stresses at the heat transmission pipe and the pipe plate, and affecting the safety of the operation of overall equipments. Although the total heat exchanging area of the once-through steam generator of spiral pipe type is relatively large, its structural feature can well solve the problem of stress concentration phenomenon, and it is more flexible in terms of space flexibility.

Because of the above advantages of the once-through steam generator of spiral pipe type, it is widely used in the fields of nuclear reactor electricity generation and power. The main designs are classified into two types which are the integrated design of large spiral pipe type and the separated modularization design.

The THTR-300 thorium high-temperature gas-cooled reactor in Germany, the Saint Flensburg high-temperature gas-cooled reactor in USA, the AGR type reactor in UK, and even the newest Sodium Cooled Fast Reactor all utilize the once-through steam generator of large spiral pipe type with multi-head winding and integration arrangement. One of the advantages of such steam generator is its compact structure. Furthermore, since the radius of curvature of the spiral is large, the volume inspection and surface inspection can be conducted. The main problems for such device include: 1) since the design can not be verified by conducting external thermal state test outside the reactor, the water flow side can not be reallocated in the operation, which is prone to result in the unevenness of steam temperature; 2) For the once-through steam generator of large spiral pipe type with integration arrangement, the spiral pipe in each layer needs independent tool pieces as the diameter of curvature of the spiral pipe in each layer is different, the processing expense thus is costly and the period is relatively long; 3) In order to prevent from the flow-induced vibration, more supporting plates are required, and the problem of local overstress for the heat exchanging pipes and the supporting plates is further highlighted.

The VG-400, АБ ТУ-ц 50, Б ГР-300 reactors in Russia and the 10 MW high-temperature gas-cooled test reactor in Tsinghua University all utilize separated modularization once-through steam generator. The main advantages for such type of steam generator are that the module can be produced in batches, the production cost is low, and each module can conduct external thermal state verification test outside the reactor. The main problems for such device include: 1) the structure is not compact enough; 2) the small radius of curvature of the spiral pipe can not conduct the volume and surface in-service inspection; 3) when a pipe blockage takes place, not only the water flow side is blocked, the side of high-temperature heat transfer material is blocked as well.

CONTENTS OF THE INVENTION

The technical problem to be solved by the present invention is to provide a steam generator, in order to overcome the respective defects of integrated, large spiral pipe type design and separated modularization design in the prior art, which may realize in-service inspection for the volume and surface of the heat transmission pipe to find the hidden safety hazard in time, and carry out a thermal to state verification test before use to verify the reliability of the design.

In order to achieve the above objectives, the present invention provides a steam generator comprising: a heat exchanger, assembled by several heat exchanging subassemblies with the same structure, wherein the heat exchanging subassembly includes a spiral heat transmission pipe bundle, a central cylinder and a sleeve, wherein the spiral heat transmission pipes with different radii are concentrically and spirally arranged in a annular space between the central cylinder and the sleeve to form one or more concentric heat exchanging pillar surfaces; a liquid header, one end of which is connected with a main water feeding pipe, and the other end of which is connected with the spiral heat transmission pipe bundle; a steam header, one end of which is connected with a main steam pipe, and the other end of which is connected with the spiral heat transmission pipe bundle.

Wherein, the heat exchanging pillar surface is comprised of one or more spiral heat transmission pipes.

Wherein, the radius of curvature of the spiral heat transmission pipe satisfies that the volume and surface sensing probe for piping materials can reach and pass through all the way.

Wherein, along the direction of axis of the central cylinder, the way of winding for the spiral heat transmission pipe bundle on the adjacent heat exchanging surfaces includes: to be arranged clockwise and anticlockwise alternatively, or to be arranged fully clockwise, or to be arranged fully anticlockwise.

Wherein, the cross section of each of the spiral heat transmission pipe bundle, the central cylinder and the sleeve is in circular shape or rectangle shape with arc corners.

Wherein, in the flowing direction of the heat transfer medium, the liquid header is arranged at the upstream of the heat exchanger and the steam header is arranged at the downstream of the heat exchanger, or, the steam header is arranged at the upstream of the heat exchanger, and the liquid header is arranged at the downstream of the heat exchanger.

Wherein, the placement modes for the steam generator include: the vertical type placement, the horizontal type placement, or the placement at any angle.

Wherein, inside the part of the connection with the liquid header, each spiral heat transmission pipe is installed with a fixed orifice plate and a detachable orifice plate; the fixed orifice plate is used for ensuring the stability of the flowing of the two-phase fluid in the spiral heat transmission pipe and distributing the resistance of each spiral heat transmission pipe; In case one of the spiral heat transmission pipes is out of work, the detachable orifice plate is used for realizing the reallocation of flow in the spiral pipe by detaching the detachable orifice plate of other spiral heat transmission pipes on the spiral pillar surfaces on which the spiral heat transmission pipe out of work is located.

In comparison with the prior art, the technical solution of the present invention has the following advantages:

1) The subassemblies can be produced in batches, which reduces the cost of production;

2) Thermal state verification test can be conducted on each subassembly outside the reactor;

3) Each subassembly is comprised of several spiral pillar surfaces, each spiral pillar surface is further comprised of multi-head spiral pipes, thereby overcoming the defect of incompact structure of the separated arrangement, and it is not prone to induce flow-induced vibration, and makes the supporting structure simple and reliable because of the small radius of curvature of the spiral pipes and stable structure;

4) The minimal radius of curvature of the spiral pipes is selected according to to the reachability of the in-service inspection tools at present, the heat transmission pipes of each subassembly are not provided with headers, but all connected to the same liquid header and the same steam header, thereby enabling the volume and surface in-service inspection. And when pipe blockage takes place, only one pipe but not a module is to be blocked, thereby maintaining the maximum availability is for the heat transmission pipes;

5) The design for the fixed orifice plate and the detachable orifice plate can make the reallocation of flow after pipe blockage simple and feasible.

SPECIFIC MODE FOR CARRYING OUT THE INVENTION

The present invention still maintains the features of modularization, but each subassembly is comprised of several spiral pillar surfaces and each spiral pillar surface is further comprised of multi-head spiral pipes, thereby overcoming the defect of incompactness of the separated structure. The minimal radius of curvature of the spiral pipes is selected according to the reachability of the in-service inspection tools at present, the heat transmission pipes of each subassembly are directly connected to the same liquid header and the same steam header, thereby enabling volume and surface in-service inspection. Furthermore, when pipe blockage takes place, only one pipe but not a module is to be blocked, thereby maintaining the maximum availability for the heat transmission pipes.

The orifice plate is installed at the water feeding inlet of each heat transmission pipe. The orifice plate is classified into two types which are the fixed orifice plate and the detachable orifice plate. Inside one subassembly, the spiral pipes on the same spiral pillar surface are all in the same flowing passage, When one of the pipes is blocked due to breakdown, the flow cannot be adjusted, thus in order to ensure the uniformity of temperature at the steam outlet, the flow of the fluids inside other pipes on the same spiral pillar surface has to be increased. Just by removing the detachable orifice plates of other pipes on such spiral pillar surface, a flow reallocation after pipe blockage can be carried out, thereby meeting the requirements for uniformity of temperature at the steam outlet. The throttle resistance of undamaged subassemblies does not require to be adjusted, so does the throttle resistance of undamaged spiral pipes in each layer in the damaged subassembly. The exact value of the orifice plate can be determined by thermal state verification test of a single subassembly, and the distribution of high temperature side flow in each subassembly can be verified by wind tunnel test of the scale model of the high-temperature side.

The embodiments of the present invention will be further described in details in combination with figures and embodiments below. The following embodiments are used for describing the present invention, but not limiting the scope thereof.

Embodiment 1

Figure 1:
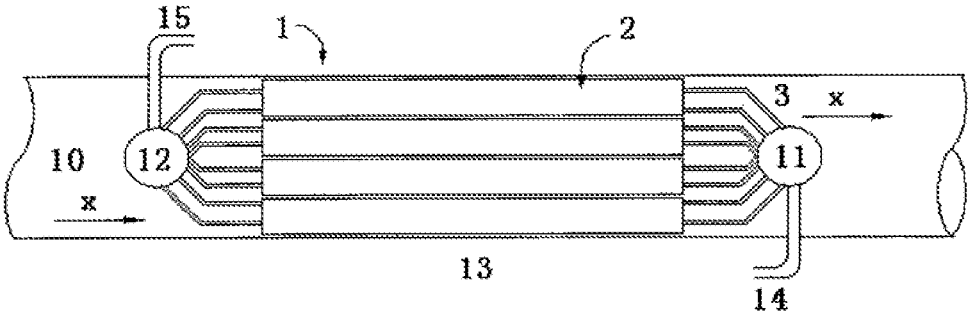
FIG. 1 is a longitudinal section view of a steam generator in the horizontal high-temperature fluid passage of embodiment 1 of the present invention.

A longitudinal section view of a steam generator in the horizontal high temperature fluid passage is shown as FIG. 1, in which the steam generator 1 is arranged in the flowing direction of the heat transfer medium x, comprised of a liquid header 11, a steam header 12 and a heat exchanger 13. In the present embodiment, the steam generator 1 is placed horizontally. The liquid header 11 and the steam header 12 are respectively arranged at the two sides of the heat exchanger 13, the present embodiment uses an upstream arrangement solution, i.e., the steam header 12 is arranged at the upstream of the heat exchanger 13, and the liquid header 11 is arranged at the downstream.

One end of the liquid header 11 is connected to a spiral heat transmission pipe bundle 3 and the other end thereof is connected to a main water feeding pipe 14. One end of the steam header 12 is connected to the spiral heat transmission pipe bundle 3 and the other end thereof is connected to a main steam pipe 15.

Figure 5:
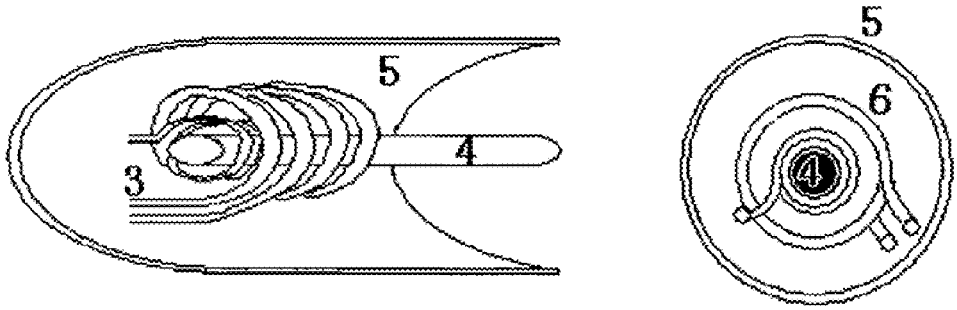
FIG. 5 is a schematic view of the internal structure of the heat exchanging subassembly in the embodiments of the present invention.

The heat exchanger 13 is assembled by several heat exchanging subassemblies 2 with the same structure. The internal structure of the heat exchanging subassembly in the present embodiment is shown as FIG. 5, in which the heat exchanging subassembly 2 is mainly comprised of a spiral heat transmission pipe bundle 3, a central cylinder 4 and a sleeve 5. The spiral heat transmission pipes 3 with different radii are concentrically and spirally arranged in an annular space between the central cylinder 4 and the sleeve 5 to form one or more concentric heat exchanging pillar surfaces 6, and each of the heat exchanging pillar surfaces 6 is comprised of one or more spiral heat transmission pipes 3.

The cross section of each of the central cylinder 4, the sleeve 5 and the spiral heat transmission pipe 3 may be in circular shape or approximate circular shape (such as rectangle shape with arc corners).

The radius of curvature of each of the spiral heat transmission pipes 3 should satisfy the requirement that the sensing probe for volume and surface of the piping materials can reach and pass through all the way.

The way of winding for the spiral heat transmission pipe 3 in the heat exchanging pillar surfaces 6 is as follows: when looking along the direction of axis of the central cylinder 4, the way of winding for the spiral heat transmission pipe 3 on the adjacent heat exchanging pillar surfaces 6 is arranged clockwise and anticlockwise alternatively, or may be arranged fully clockwise, or arranged fully anticlockwise.

Figure 6:
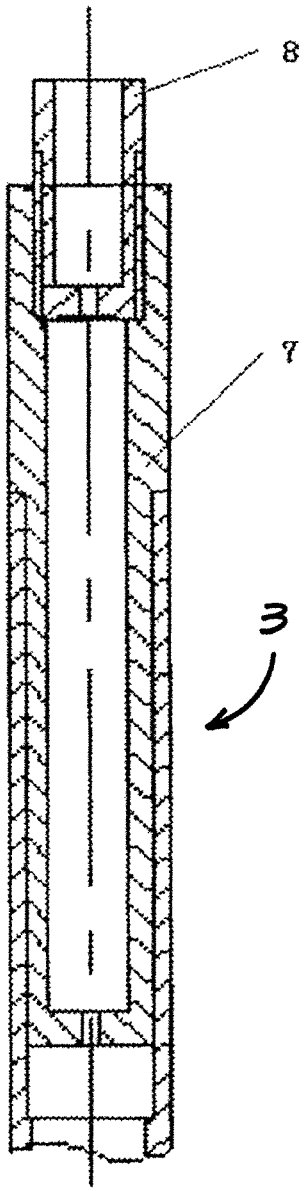
FIG. 6 is a schematic view of the structure of the orifice plate at the inlet of the spiral pipe in the embodiments of the present invention.

Inside the part of the connection with the liquid header 11, each spiral heat transmission pipe 3 is installed with an orifice plate; the structure of the orifice plate at the inlet of the spiral pipe in the embodiment of the present invention is shown as FIG. 6. The orifice plate is classified into two types which are the fixed orifice plate 7 and the detachable orifice plate 8. When one spiral heat transmission pipe 3 is out of work, the reallocation of flow in the spiral pipe 3 is realized by detaching the detachable orifice plate 8 of other spiral heat transmission pipes 3 on the spiral pillar surfaces 6 on which the spiral heat transmission pipe 3 out of work is located.

Embodiment 2

Figure 2:
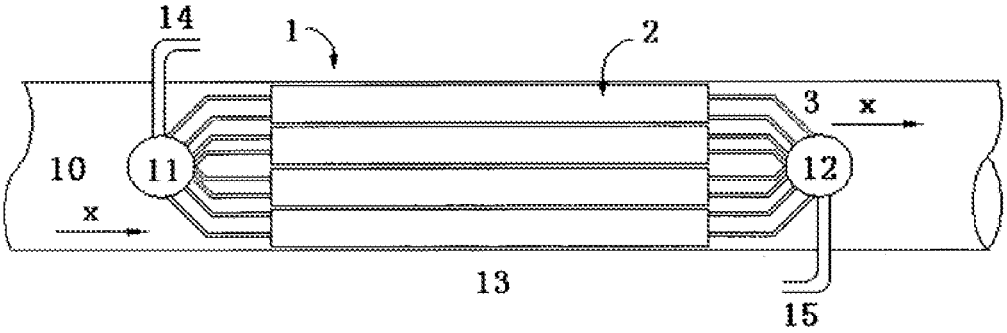
FIG. 2 is a longitudinal section view of a steam generator in the horizontal high-temperature fluid passage of embodiment 2 of the present invention.

A longitudinal section view of a steam generator in the horizontal high temperature fluid passage is shown as FIG. 2. The steam generator of the present embodiment is similar to that of embodiment 1, with the only distinction that the liquid header 11 and the steam header 12 in the present embodiment uses a downstream arrangement solution, i.e., the steam header 12 is arranged at the downstream of the heat exchanger 13, and the liquid header 11 is arranged at the upstream.

Embodiment 3

Figure 3:
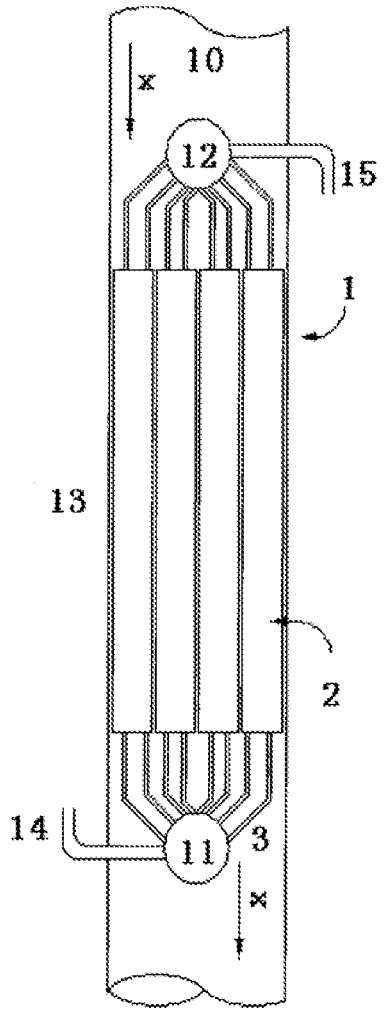
FIG. 3 is a longitudinal section view of a steam generator in the vertical high-temperature fluid passage of embodiment 3 of the present invention.

A longitudinal section view of a steam generator in the vertical high temperature fluid passage is shown as FIG. 3, in which the steam generator 1 includes a heat exchanger 13, a liquid header 11 and a steam header 12. In the present embodiment, the steam generator 1 is placed vertically. The liquid header 11 and the steam header 12 are respectively arranged at the two sides of the heat exchanger 13. The present embodiment uses an upstream arrangement solution, i.e., the steam header 12 is arranged at the upstream of the heat exchanger 13, and the liquid header 11 is arranged at the downstream.

The heat exchanger 13 is assembled by several heat exchanging subassemblies 2 with the same structure. The internal structure of the heat exchanging subassembly in the present embodiment is shown as FIG. 5, in which the heat exchanging subassembly 2 comprises a spiral heat transmission pipe bundle 3, a central cylinder 4 and a sleeve 5; the spiral heat transmission pipes 3 with different radii are concentrically and spirally arranged in an annular space between the central cylinder 4 and the sleeve 5, to form one or more concentric heat exchanging pillar surfaces 6. The heat exchanging pillar surface 6 is comprised of one or more spiral heat transmission pipes. The radius of curvature of the spiral heat transmission pipe 3 satisfies that the sensing probe for volume and surface of the piping materials can reach and pass through all the way, and along the direction of the axis of the central cylinder, the way of winding for the spiral heat transmission pipe 3 on the adjacent heat exchanging surfaces includes: to be arranged clockwise and anticlockwise alternatively, or to be arranged fully clockwise, or to be arranged fully anticlockwise.

The cross section of each of the spiral heat transmission pipe bundle 3, the central cylinder 4 and the sleeve 5 is in circular shape or rectangle shape with arc corners. One end of the liquid header 11 is connected to the main water feeding pipe 14 and the other end thereof is connected to the spiral heat transmission pipe bundle 3. One end of the steam header 12 is connected to the main steam pipe 15 and the other end thereof is connected to the spiral heat transmission pipe bundle 3.

As shown in FIG. 6, inside the part of the connection with the liquid header, each spiral heat transmission pipe is installed with a fixed orifice plate 7 and a detachable orifice plate 8. The fixed orifice plate 7 is used for ensuring the stability of the flowing of two-phase fluid in the spiral heat transmission pipe and distributing the resistance of each spiral heat transmission pipe; and when one spiral heat transmission pipe is out of work, the detachable orifice plate 8 is used for realizing the reallocation of flow in the spiral pipe by detaching the detachable orifice plate of other spiral heat transmission pipes on the spiral pillar surfaces on which the spiral heat transmission pipe out of work is located.

Embodiment 4

Figure 4:
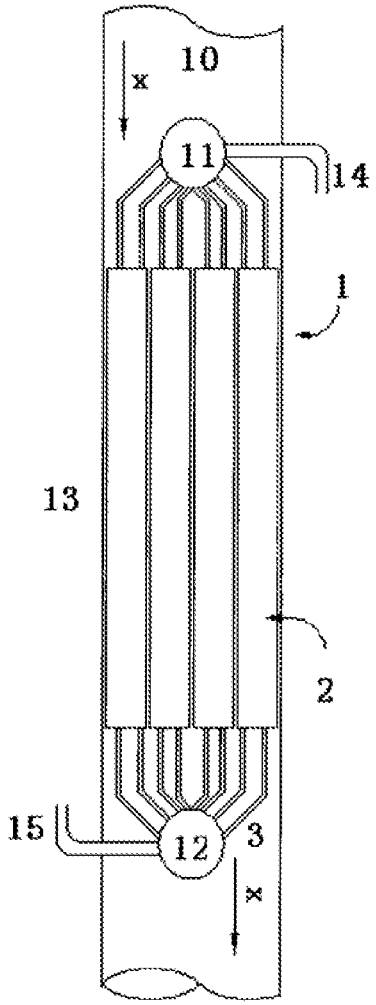
FIG. 4 is a longitudinal section view of a steam generator in the vertical high-temperature fluid passage of embodiment 4 of the present invention.

A longitudinal section view of a steam generator in the vertical high temperature fluid passage is shown as FIG. 4, the steam generator of the present embodiment is similar to that of embodiment 3 with the only distinction that arrangement solution is used for the liquid header 11 and the steam header 12 in the present embodiment uses a downstream arrangement solution, i.e., the steam header 12 is arranged at the downstream of the heat exchanger 13, and the liquid header 11 is arranged at the upstream.

The properties of the heat exchanging subassembly 2, the fixed orifice plate 7 and the detachable orifice plate 8 of the present invention are such that thermal state test verification can be conducted before use.

The above descriptions are just the preferred embodiments of the present invention, and it needs to be stated that without departing from the technical principle of the present invention, a person skilled in the art may also make some improvements and embellishments, which should also be regarded as falling into the scope of protection of the present invention.

INDUSTRIAL APPLICABILITY

The steam generator of the present invention includes a heat exchanger, a liquid header and a steam header. A single subassembly of the present invention can be subject to thermal state verification test outside the reactor; meanwhile the structure of each subassembly is stable and can be produced in batches, thereby reducing the cost of production. The steam generator of the present invention can realize in-service inspection for the volume and surface of the heat transmission pipe, so as to find the hidden safety hazard in time, and a thermal state verification test can be carried out before use. Thus, the present invention can be utilized in the industry.

The invention claimed is:

1. A steam generator, comprising:

a heat exchanger, assembled by several heat exchanging subassemblies with the same structure, each heat exchanging subassembly includes a spiral heat transmission pipe bundle including a plurality of spiral heat transmission pipes, a central cylinder and a sleeve, the spiral heat transmission pipes having different radii are concentrically and spirally arranged in an annular space between the central cylinder and the sleeve, to form one or more concentric heat exchanging pillar surfaces;

a liquid header, one end of which is connected with a main water feeding pipe, and the other end of which is connected an end of each heat exchanging subassembly; and a steam header, one end of which is connected with a main steam pipe, and the other end of which is connected with an opposing end of each heat exchanging subassembly;

each spiral heat transmission pipe including a radius of curvature configured to receive a sensing probe for determining a volume and a surface area of each transmission pipe such that the sensing probe can reach the transmission pipes and pass through all the way, wherein inside a part of the connection with the liquid header, each spiral heat transmission pipe is installed with a fixed orifice plate and a detachable orifice plate, the fixed orifice plate being used for ensuring the stability of the flowing of two-phase fluid in the spiral heat transmission pipe and distributing the resistance of each spiral heat transmission pipe, and when one spiral heat transmission pipe is out of work, the detachable orifice plate is used for realizing the reallocation of flow in the spiral pipe by detaching the detachable orifice late of other spiral heat transmission pipes on the spiral pillar surfaces on which the spiral heat transmission pipe that is out of work is located.

2. The steam generator of claim 1, wherein along the direction of axis of the central cylinder, the way of winding for the spiral heat transmission pipes in the spiral heat transmission pipe bundle are arranged to be one of clockwise, counterclockwise or a combination of clockwise and counterclockwise.

3. The steam generator of claim 1, wherein a cross section of each of the spiral heat transmission pipe bundle, the central cylinder and the sleeve is in circular shape or rectangle shape with arc corners.

4. The steam generator of claim 1, wherein the liquid header is arranged upstream of the heat exchanger, the steam header is arranged downstream of the heat exchanger, or, the steam header is arranged upstream of the heat exchanger and the liquid header is arranged downstream of the heat exchanger.

* * * * *